US008418406B2

(12) United States Patent
Zimmer et al.

(10) Patent No.: US 8,418,406 B2
(45) Date of Patent: Apr. 16, 2013

(54) ACCELERATION AND DECELERATION DEVICE WITH TWO CARRIER ELEMENTS

(76) Inventors: Günther Zimmer, Rheinau (DE); Martin Zimmer, Rheinau (DE)

( * ) Notice: Subject to any disclaimer, the term of this patent is extended or adjusted under 35 U.S.C. 154(b) by 293 days.

(21) Appl. No.: 12/806,455

(22) Filed: Aug. 12, 2010

(65) Prior Publication Data

US 2011/0023370 A1 Feb. 3, 2011

Related U.S. Application Data

(63) Continuation-in-part of application No. PCT/EP2009/000200, filed on Feb. 13, 2009.

(30) Foreign Application Priority Data

Feb. 13, 2008 (DE) ..... 10 2008 009 046

(51) Int. Cl.
*E05F 15/06* (2006.01)
*F15B 15/22* (2006.01)

(52) U.S. Cl.
USPC ..... 49/379; 49/279; 49/409; 16/49; 312/139

(58) Field of Classification Search ..... 49/409–410, 49/364, 379, 358, 360, 279; 16/82–86 C, 16/49, 66, 69, 70; 312/139
See application file for complete search history.

(56) References Cited

U.S. PATENT DOCUMENTS 2,602,662 A * 7/1952 Kintzinger ..... 267/176
2,925,860 A * 2/1960 Dunn ..... 160/87
4,920,609 A * 5/1990 Lin ..... 16/66
4,948,103 A * 8/1990 Bowden et al. ..... 267/34
5,446,944 A * 9/1995 Coleman et al. ..... 16/85
5,727,286 A * 3/1998 Shen ..... 16/49
5,829,508 A * 11/1998 DeBower et al. ..... 160/371
6,910,557 B2 * 6/2005 Doornbos et al. ..... 188/290
6,953,233 B2 * 10/2005 Lam et al. ..... 312/333
6,957,807 B2 * 10/2005 Zimmer et al. ..... 267/64.11
7,399,041 B2 * 7/2008 Prentner et al. ..... 312/333
2003/0141638 A1 * 7/2003 Salice ..... 267/34
2004/0150143 A1 * 8/2004 Zimmer et al. ..... 267/64.11
2006/0118371 A1 * 6/2006 Zimmer et al. ..... 188/280
2006/0175946 A1 * 8/2006 Le ..... 312/333
2006/0186772 A1 * 8/2006 Lam et al. ..... 312/333
2007/0101539 A1 * 5/2007 Sutterlutti et al. ..... 16/49
2007/0114896 A1 5/2007 Orita
2007/0186481 A1 * 8/2007 Tomita et al. ..... 49/409

(Continued)

FOREIGN PATENT DOCUMENTS

DE 2 048 950 4/1972
DE 10 2006 019 351 10/2007

(Continued)

*Primary Examiner* — Katherine Mitchell
*Assistant Examiner* — Justin Rephann
(74) *Attorney, Agent, or Firm* — K. J. Bach

(57) ABSTRACT

In an acceleration and deceleration device which includes at least one energy storage device and a cylinder with at least one piston movably disposed in the cylinder and moved therein by a carrier element and a sliding door including a slidable door panel provided with an acceleration and deceleration device, a second carrier element is provided guiding either the first piston or the second piston for movement in the cylinder so as to control the movement of pistons and of the sliding door near its end positions.

7 Claims, 8 Drawing Sheets

U.S. PATENT DOCUMENTS

| | | | | |
|---|---|---|---|---|
| 2008/0244862 | A1* | 10/2008 | Tooyama | 16/82 |
| 2009/0205485 | A1* | 8/2009 | Zimmer et al. | 92/8 |
| 2009/0271946 | A1* | 11/2009 | Lam et al. | 16/84 |
| 2009/0273129 | A1* | 11/2009 | Zimmer et al. | 267/170 |
| 2009/0273263 | A1* | 11/2009 | Berger | 312/334.1 |
| 2010/0071154 | A1* | 3/2010 | Bortoluzzi | 16/85 |
| 2011/0203183 | A1* | 8/2011 | Iwaki | 49/358 |

FOREIGN PATENT DOCUMENTS

| | | |
|---|---|---|
| EP | 1 426 535 | 6/2004 |
| EP | 1 582 114 | 10/2005 |
| GB | 1 316 551 | 5/1973 |
| GB | 2 416 294 | 1/2006 |

* cited by examiner

ACCELERATION AND DECELERATION DEVICE WITH TWO CARRIER ELEMENTS

This is a Continuous-In-Part Application of pending international patent application PCT/EP2009/000200 filed Feb. 13, 2009 and claiming the priority of German patent application 10 2008 009 046.8 filed Feb. 13, 2008.

BACKGROUND OF THE INVENTION

The invention concerns an acceleration and deceleration device, which includes at least an energy storage structure and a piston guided in a cylinder by means of a carrier element and also a sliding door arrangement provided with such acceleration and deceleration devices.

DE 10 2006 019 351 A1 discloses an acceleration and deceleration device. To move a sliding door panel to its end position during closing as well as during opening, two acceleration and deceleration devices are necessary which requires a relatively large installation space.

It is the object of the present invention to provide a compact acceleration and deceleration device which makes a controlled approach at the two end positions in both travel directions possible.

SUMMARY OF THE INVENTION

In an acceleration and deceleration device which includes at least one energy storage structure and a cylinder with at least one piston movably disposed in the cylinder and moved therein by a carrier element and a sliding door including a slidable door panel provided with an acceleration and deceleration device a second carrier element is provided guiding either the first piston or the second piston for movement in the cylinder so as to control the movement of pistons and of the sliding door near its end positions.

The invention will become more readily apparent from the following description of particular embodiments thereof described below with reference to the accompanying drawings.

DESCRIPTION OF PARTICULAR EMBODIMENTS

Figure 1:
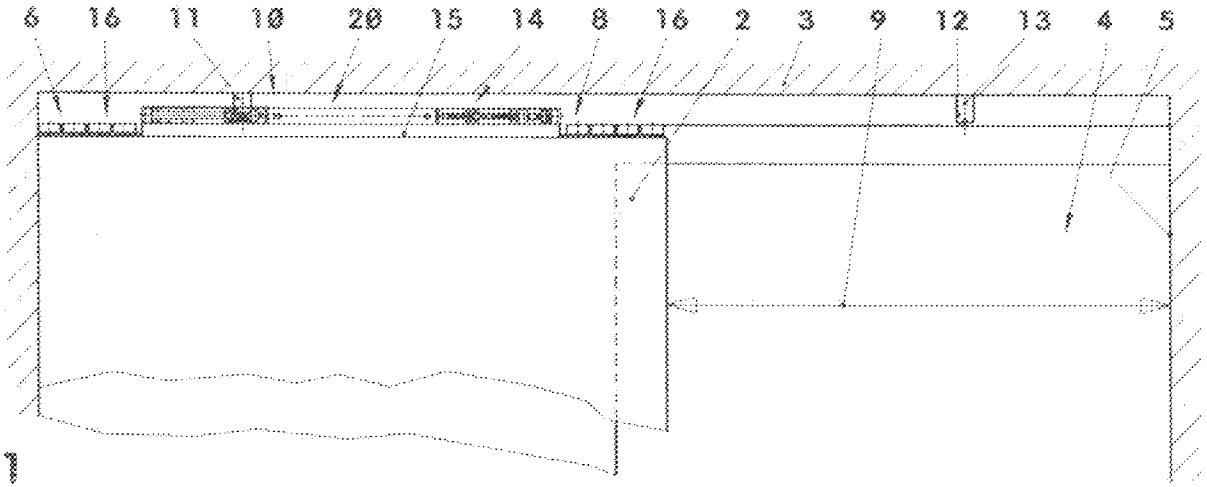
FIG. 1 shows a sliding door in an open position.
Figure 2:
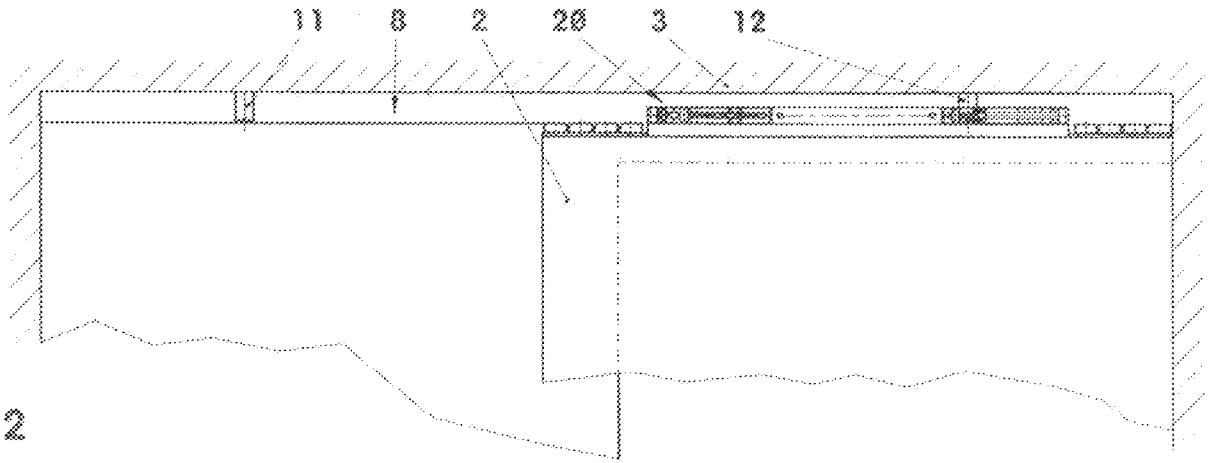
FIG. 2 shows a sliding door in a closed position.
Figure 3:
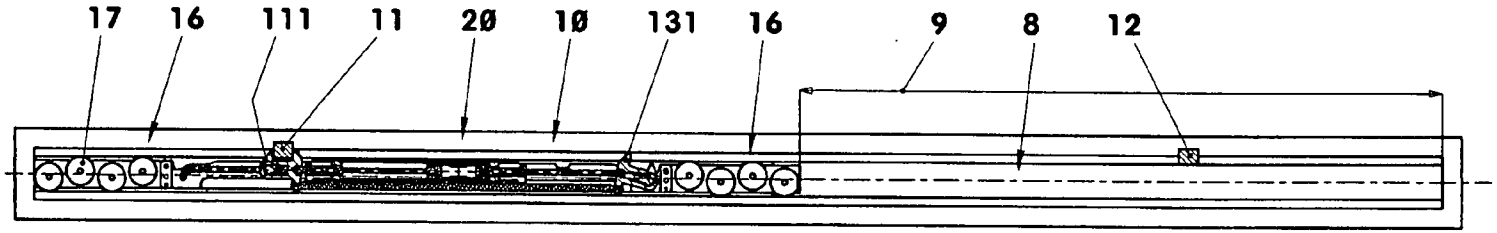
FIG. 3 is a partial sectional view of a sliding door arrangement.

FIGS. 1 and 2 show a sliding door arrangement with a sliding door panel 2 which is slidingly guided in a door frame 3 by a door guide system 10. FIG. 1 shows the sliding door panel 2 in an open position and FIG. 2 shows the sliding door panel 2 in a closed position. FIG. 3 is a top view of an open door panel 2 with the guide system 10 shown in a longitudinal cross-section.

Instead of a door frame 3 can be supported in components which are formed differently but still have the guide and support functions. The guide system 10 may also be used in connection with sliding windows drawers etc.

The sliding door panel is for example a closet door panel, a door panel for separating rooms in apartments in industrial buildings etc. It may consist for example of plastic, metal or wood with or without glass inserts.

In the open position, see FIG. 1, the sliding door panel extends for example with the handle area from the door frame 3. In the closed position, see FIG. 2, the slide door panel 2 closes the door opening 4 of the door frame 3. A wall-side door panel-accommodating track 6 and a vertical frame part 5 delimit the door opening 4 as well as the door panel travel distance 9 between the open and the closed position of the sliding door panel 2. The overall length of the door frame 3 is therefore determined by the length of the sliding door panel 2 and the door panel travel distance 9. The length of the sliding door panel 2 is in the shown exemplary embodiment 600 mm and the door panel travel distance 9 is 500 mm. Above the sliding door panel 2, the door frame 3 comprises in the shown embodiment a guide channel 9, in which the guide system 10 is arranged.

The guide system 10 comprises two stationary and one movable guide part 11, 12, 14. The stationary guide components 11, 12 are in the shown exemplary embodiment mounted in the guide channel 8. The guide part 15 which is movable relative thereto is arranged at the top end of the slide door panel 2. But it is also possible to arrange the guide component 11, 12 which herein have been called stationary, on the movable sliding door panel 2. They are then movable relative to a second guide part 14 mounted in the guide channel 8.

The stationary guide components 11, 12 are for example two operating elements, which are spaced from each other. The operating element 11 shown here at the left has a distance of for example 190 mm from the left end of the guide channel 8; the operating element 12 shown at the right has the same distance from the right end of the guide channel 8.

The operating element 11, 12 may for example be a bolt 11, 12, which is mounted to the top wall of the guide channel 8 by mounting members 13. It has for example a square cross-section with an edge length of 12 mm. The operating elements 11, 12 may also attached to the side walls of the guide channel 8.

The movable guide part 14 comprises groups 16 of guide rollers 17 which are arranged on the top side of the slide door panel 2 and mounted on an adapter component 15 and an acceleration and deceleration device 20. In the exemplary embodiment shown herein—the slide door panel 2 has for example a mass of 80 kg—two groups 16, each with four guide rollers 17, are arranged on the slide door panel 2, see FIG. 3. In each case one group 16 is shown on the left and one group 16 is shown on the right of the acceleration and deceleration device 20. In each group two guide rollers 17 project upwardly and the two other groups project downwardly from the sliding door panel 2. The length of the individual groups 16 in the longitudinal direction of the sliding door panel 2 is in this case 100 mm.

Figure 4:
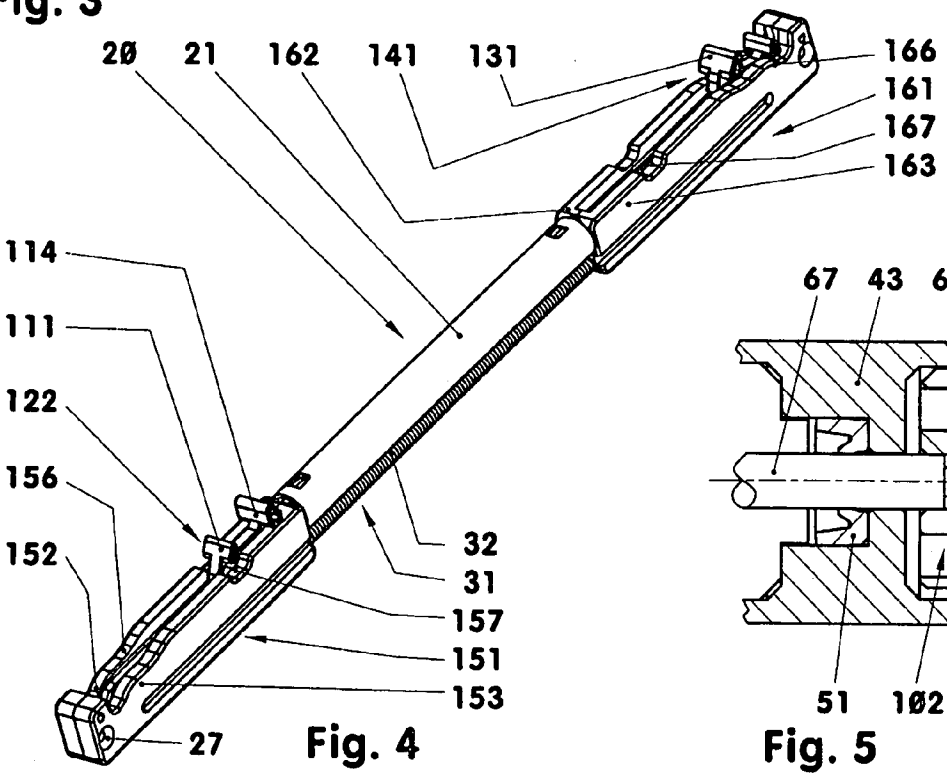
FIG. 4 is a perspective view of an acceleration and deceleration device.

FIG. 4 is a perspective view of a, for example pneumatic, acceleration and deceleration device 20. It comprises a central cylindrical tube 21 at whose opposite front ends a frame member 151, 161 is arranged. In each of the frame members 151, 161 a carrier element 111, 131 is supported so as to be longitudinally slidable between a park position 121, 141, and an end position 122, 142 remote from the park position 121, 141. As shown in FIG. 4, the right end carrier element 131 is shown in the park position 141. It is pivoted there by 15 degrees in the direction toward the adjacent front end of the acceleration and deceleration device 20. The left end carrier element 111 is in the end position 122 opposite the park position 121. Below the cylindrical tube 21, an energy storage device 32 is arranged by which the two carrier elements 111, 131 are interconnected. This energy storage device 32 is for example a tension spring 32. The length of the acceleration and deceleration device 20 is in this embodiment for example 400 mm that is two thirds of the length of the sliding door panel 2. The height of the installed arrangement 20 is for example 15 mm. To mount the acceleration and deceleration device 20 on the slide door panel 2 or on an adapter 15 disposed on the sliding door panel 2 two screws are used which are each inserted into a throughbore 27.

The two frame members 151, 161 consist in this embodiment for example of two mirror-reversed guide structures 152, 152, 162, 163, which are interconnected for example by connecting clips.

Figure 5:
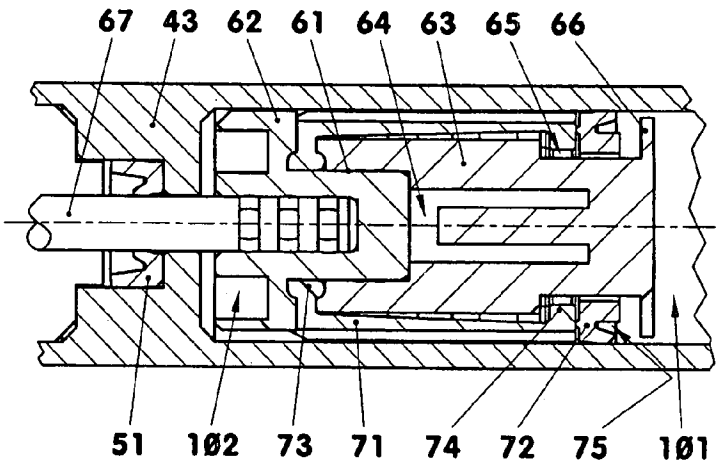
FIG. 5 is a cross-sectional view of a detail of FIG. 4.
Figure 9:
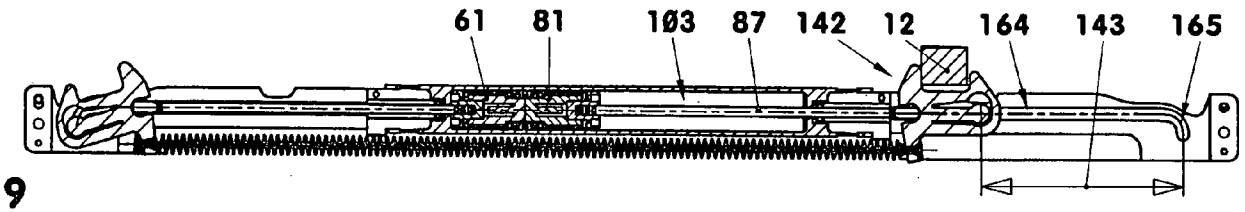
FIG. 9 shows the acceleration and deceleration device with the sliding door in a closed position.
Figure 10:
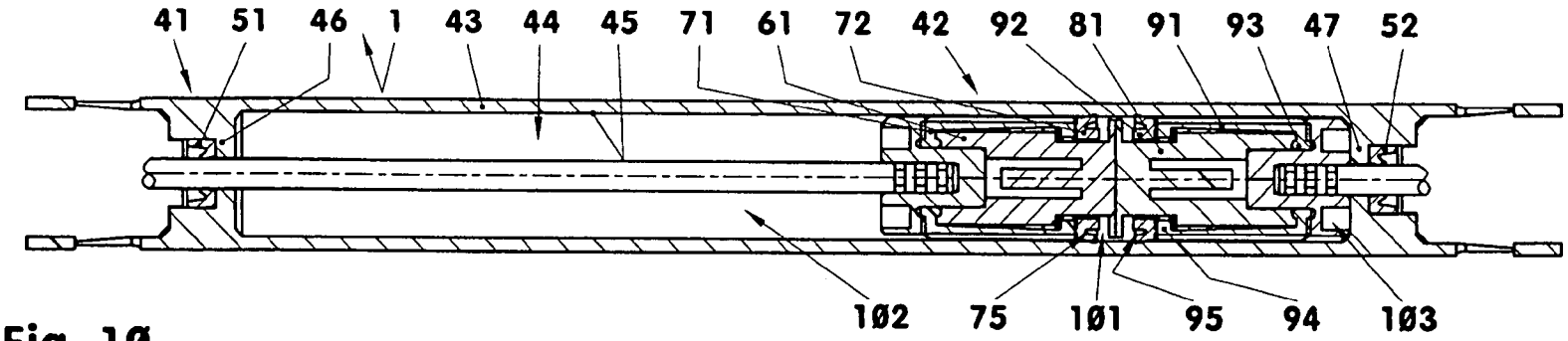
FIG. 10 shows, in a cross-sectional view, a detail of the acceleration and deceleration device of FIG. 6.
Figure 11:
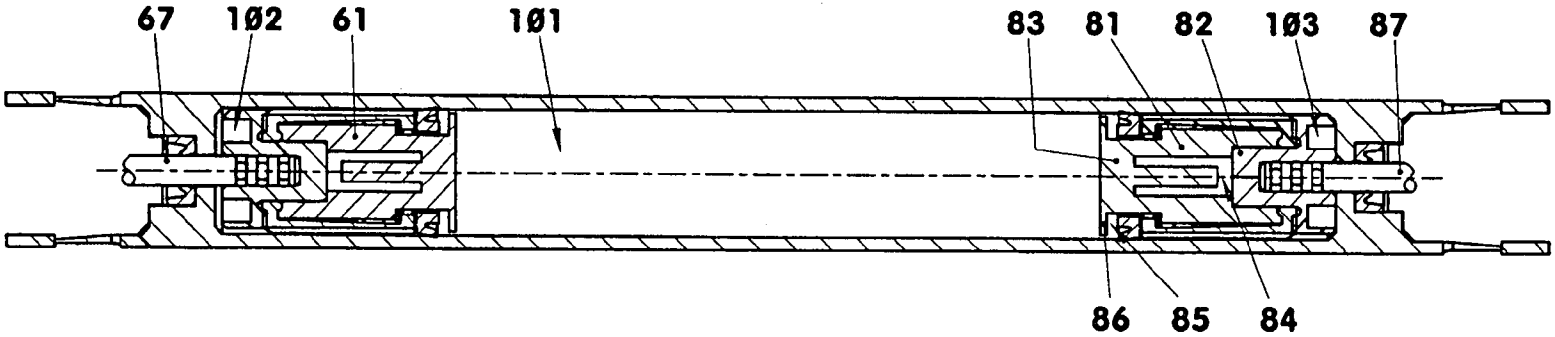
FIG. 11 is a cross-sectional view of a detail of the acceleration and deceleration device of FIGS. 7 and 8.

The FIGS. 5, 10 and 11 are cross-sectional longitudinal views of cylindrical tube 21. In the cylindrical tube 21, two pistons 61, 81 of a cylinder-piston unit 42 are arranged. Both pistons 61, 81, which are of mirror-reversed design are axially-movable in the same cylinder 43 by means of piston rods 67, 87. In each case, one piston rod 67, 87 extends through a front end 46, 47 of the cylinder 43. The piston rod head 68, 88 of each piston rod 67, 87 is connected pivotally to a respective carrier element 111, 131 see FIGS. 6-9. The travel distance 123, 143 of the carrier elements 111, 131 that is, the piston strokes are in the exemplary embodiment in each case 68 mm.

The cylinder interior 44 has a length of for example 117 mm and a constant internal diameter of 13 mm. The cylinder interior is consequently shorter than the sum of the travel distances 123, 143 of the carrier elements 111, 131. The internal cylinder wall 45 may be smooth. Possibly the internal cylinder wall 45 of the cylinder 43 may be provided in some areas with one or more grooves. They may be arranged for example symmetrically with respect to a central transverse plane of the cylinder 43 and may have a length of for example 30% of a piston's travel length or stroke. The width of a groove is then for example one millimeter.

The individual piston 61, 81, see FIG. 5, comprises for example two parts, including a piston bottom part 62, 82 facing the piston rod seal 51, 52 and a piston head part 63, 83. Into the piston bottom part 62, 82, a piston rod 67, 87 is inserted and for example cemented therein. At the opposite front end, the piston bottom part 62, 82 is cylindrical for mounting the piston head part 63, 83. In the shown exemplary embodiment, an open space 64, 84 is formed in the piston head part 63, 83 into which the air is displaced during the cementing of the two piston parts 62, 63, 82, 83.

Between the two piston parts 62, 63, 82, 83, a seal element 71, 91 is engaged in a form-locking manner in a clamping area 73, 93. The seal element 71, 91 is for example pot-shaped. It has a length which exceeds its diameter by 30%. The diameter in the shown exemplary embodiment is 95% of the inner diameter of the cylinder 43. The wall thickness of the seal element 71, 91, becomes smaller from the engagement area 73, 93 toward the end of the seal element 71, 91 remote from the engagement area 73, 93. At the remote end, the seal element 71, 91 has an inner annular shoulder 74, 94 which extends, with play, into an accommodation area 65, 85. At the outer surface of the seal element 71, 91 longitudinal grooves may be formed into the seal element. The seal element 71, 91 consists for example of a nitrile-butadiene-caoutchuc and has for example a halogenized surface.

In the accommodation area 65, 85 of the piston head part 63, 83 an additional seal element 72, 92, for example a shaft seal ring 72, 92, is disposed adjacent an engagement flange 66, 86. Its inner diameter is larger than the diameter of the accommodation area 65, 85 and its outer diameter is at least as large as the smallest inner diameter of the cylinder. The annular groove 75, 95 of the seal ring 72, 92 faces in a direction away from the piston rod 67, 87.

In the accommodation area 65, 85, a further seal element such as an O-ring may be arranged. By means of this O-ring, the two other seal elements 71, 72; 91, 92 may be pretensioned during assembly.

Both pistons 61, 81, therefore carry piston seal elements 71, 72; 91, 92, which, upon displacement, achieve a sealing effect only in one travel direction, that is, during movement of the particular piston 61, 81 into the cylinder 43.

In this exemplary embodiment, the device 20 comprises a displacement chamber 101, which is delimited by the two pistons 61, 81 as well as two compensation chambers 102, 103 delimited in each case by a piston 61, 81 and a cylinder end wall 46, 47. The cylinder interior 44 is for example isolated toward the ambient 1. The cylinder-piston unit 42 however may also be so constructed that the compensation chambers 102, 103 are in communication with the ambient 1.

At least during rapid movement of a piston 61, 81 into the cylinder 43, the piston separates quasi-hermitically the displacement chamber 101 from the compensation chamber 102, 103. During outward movement of the piston 61, 81 air flows from the respective compensation chamber 102, 103 via the seal elements 71, 72; 91, 92 into the displacement chamber 101.

The carrier element 111, 131 engages the respective piston rod head 68, 88 and is guided by means of two guide bolt pairs in the frame structure 151, 161. The center line of the piston rod head 68, 88 and the center lines of the guide bolt pairs are disposed in a common plane. The section of the carrier element 111, 131 projecting from the frame structure 151, 161 has an accommodation recess 112, 132, which is delimited by two carrier surfaces 113, 114, 133, 134, which are spaced from each other, and also a free carrier surface area 115, 135.

The two carrier surface areas 113, 114; 133, 134 extend for example normal to the common plane, which is formed by the center axes of the two guide bolts. The carrier surface 115, 135 extends for example parallel to this plane. The transitions between the surface areas 113, 115; 115, 114; 133, 135, 135, 134 are rounded. The carrier element 111, 131 is elastically deformable with respect to its guide bolts. It can for example be compressed during assembly to permit installation of the operating element 11, 12.

The two guide structures 152, 153; 162, 163 receiving a carrier element 111, 131 have elongated openings 154, 164 for guiding the carrier elements 111, 131. They have at their ends remote from the cylinder 43 areas 155, 165, which are curved away from the accommodation recesses 112, 132. In the park position, the guide bolt pair remote from the cylinder 43 is disposed in the curved area 155, 165 of the elongated openings 154, 164.

The frame structures 151, 161 have in the area of the park position 121, 141, an inclination 156, 160 and in an intermediate lift area, a recess 157, 167.

The tension spring 32—it has for example a constant cross-section—is mounted in the two carrier elements 111, 131 by retaining ears. It is also possible to use two energy storage devices 32, each being connected to a carrier element 111, 131 and for example a frame structure part 151, 161.

Upon assembly of the acceleration and deceleration device 120, first, for example the carrier elements 111, 131 with the piston rods 67, 87, the piston rod seals 51, 52 and the pistons 61, 81 with the piston seals 71, 72; 91, 92 are pre-assembled. These units are then placed into the frame parts 151, 161. Then the frame parts 151, 161 are placed at opposite sides of the cylindrical tube 21 and the pistons 61, 81 are introduced into the cylinder 43. After the mounting of the piston rod seals 51, 52, the tension spring 32 is mounted between the carrier elements 111, 131. The completed unit can then be attached to a sliding door panel 2 with or without adapter 15.

The FIGS. 6-9 show, in cross-sectional view, the acceleration and deceleration device 20 during closing of the sliding door panel 2.

Figure 6:
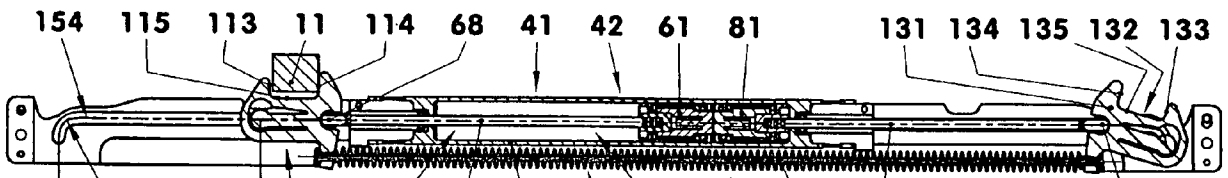
FIG. 6 shows an acceleration and deceleration device with the sliding door in an open position.

When the sliding door panel 2 is in an open position, see FIGS. 1, 2 and 6, the right end carrier element 131 is in a locked park positions 141. The left end carrier element 111 is in the end position 122 of its travel range 123 remote from its park position 121 and is in engagement with the left operating element 11.

The energy storage device 32 is for example partially charged or relaxed. In the cylinder 43, the left piston 61 is disposed in its right end position. In this case, it is in contact with the right piston 81 which is also in its right end position. However, the two pistons 61, 81 do not need to contact each other. The displacement chamber 101, FIG. 10, is reduced to its minimum size. Also, the right compensation chamber 103 has reached its minimum volume. The left compensation chamber 102 has in the shown position its maximum volumes see FIG. 10.

Figure 7:
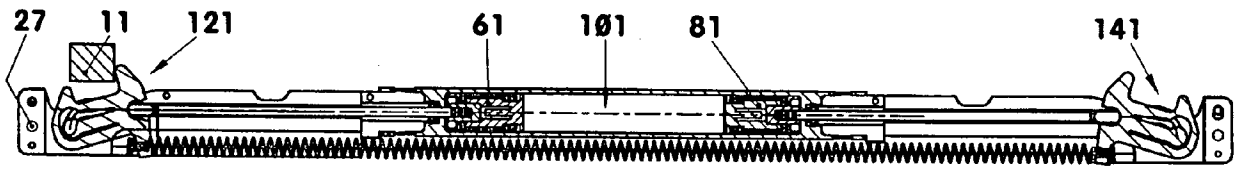
FIG. 7 shows the acceleration and deceleration device after the release of the operating element.

When the sliding door panel 2 is closed, in the representation as shown in FIG. 7, the acceleration and deceleration device 20 moves together with the sliding door panel 2 to the right relative to the stationary operating element 11. The left operating element 11 pulls the left carrier element 111 toward the park position 121. In this way, the energy storage device 32 is charged. In the position as shown in FIG. 7 both carrier elements 111, 131 are in their respective park positions 121, 141, the left operating element 11 is released.

During closing of the sliding door panel 2, the carrier element 111 pulls the left piston 61 toward the left. During this process air flows out of the compensation chamber 102 into the displacement chamber 101 while deforming the seal elements 71, 72. As soon as the left carrier element 111 is locked in its park position 121, the displacement chamber 101 has reached its maximum volume. The two compensation chambers 102, 103 now have their minimum volumes, see FIG. 11. The energy storage device 32 is charged.

Figure 8:
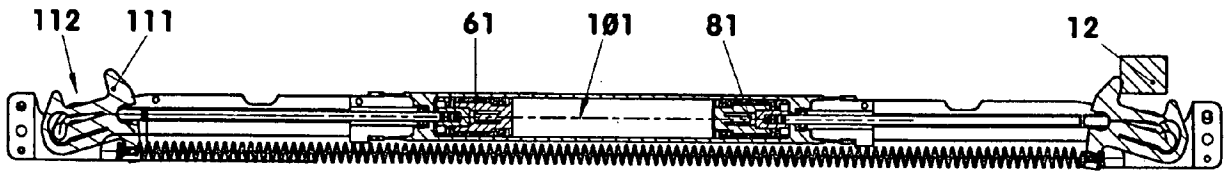
FIG. 8 shows the acceleration and deceleration device upon reaching a second operating element.

Upon further closing of the sliding door panel 2, see FIG. 8, the acceleration and deceleration device 20 approaches the right operating element 12. In a partial movement step near the end position of the sliding door panel 2, the right operating element 12 comes into contact with the right carrier element 131 and moves it out of its park position 141, while releasing the locking thereof, toward the end position 142 remote from the park position 111. During this process, the movement of the sliding door panel 2 is slowed down by the deceleration device 41. At the same time, the energy storage device 32 is discharged while the pulling the sliding door panel 2 to its end position, see FIGS. 2 and 9. There the sliding door panel 2 arrives without a jerk. In this position, the right carrier element 131 is in the end position 142 remote from the park position 141, whereas the left carrier element 111 is locked in the park position 121.

During this movement, the carrier element 131 moves the piston 81 by means of the piston rod 87 to the left. Already with a slight displacement of the piston 81, the air in the displacement chamber 101 is compressed. The seal ring 92 is pressed by the compressed air radially outwardly into engagement with the inner cylinder wall 45. The first undeformed seal element 91 is also pressed into contact with the cylinder wall 45. The two seal elements 91, 92 seal the displacement chamber 10, quasi-hermetically, with respect to the compensation chamber 103 delimited by the piston 81 and further slow down the stroke movement of the piston 81 by the friction at the cylinder wall 45. Also, the seal elements 71, 72 of the left piston 61 are pressed into contact with the inner cylinder wall 45 but this piston 61 remains rested. In the right compensation chamber 103, the pressure is reduced which supports the retarding of the sliding door panel 2.

For example after passing the rear end of the groove in the inner cylinder wall 45, air flows out of the displacement chamber 101 past the seal elements 91, 92 into the compensation chamber 103. Such an air flow however is also possible with a different shape of inner cylinder wall 45 or in the area of the piston 81. The air pressure in the displacement chamber 101 collapses. The vacuum in the compensation chamber is eliminated. As soon as the seal elements 91, 92 are no longer in tight engagement with inner cylinder wall 45 additional air flows from the displacement chamber 101 into the compensation chamber 103. The pressure in the displacement chamber 101 drops suddenly. The two seal elements 91, 92 again assume their initial position they had before the beginning of the stroke movement. The sliding door panel 2 at this point has only a small residual speed.

During the inward movement of the piston 81, the tension spring 32 is being relaxed. The acceleration force of the tension spring 32 becomes smaller with the movement of the piston. The sliding door panel 2 now moves slowly with little speed and little deceleration to its end position. There it stops without a jerk. Because of the small force of the acceleration device 31, there is also protection from pinching provided during closing of the door.

In the closed end position of the sliding door panel 2, see FIGS. 2 and 9, the displacement chamber 101 and the left compensation chamber 102 have minimal volumes, while the right compensation chamber 103 has a maximum volume.

The opening of the sliding door panel 2 occurs in a reversed order, see FIGS. 9-6. In this case, first, the volume of the displacement chamber 101 is increased by pulling out the right piston rod 87. The tension spring 32 is tensioned in the process. In the open end position of the sliding door panel 2, the left carrier element 11 then comes into contact with the left operating element 111 and causes an insertion of the left piston 61 into the cylinder 43. Analog to the closing of the sliding door panel 2 now, during opening of the sliding door panel 2, the volume of the displacement chamber 101 is reduced and the volume of the compensation chamber 102 is increased. The tension spring 32 is being relaxed. The sliding door panel 2 now moves slowly and with little speed and little deceleration to its open end position. There, it remains at rest without jerk.

During closing and opening of the sliding door panel 2 for example the travel distances 123, 143 of the two carrier elements 111, 131 are the same. The travel distances or strokes 123, 143 of the acceleration and deceleration device 20 are in the exemplary embodiment in each case 11% of the length of the sliding door panel 2. The strokes 123, 143 however may be different.

It is also possible to open the sliding door panel 2 only half way and then close it again. In this case, the acceleration and deceleration device 20 which has been moved during opening from the position as shown in FIG. 9 to that of FIG. 8 is again moved back to the position as shown in FIG. 9. The acceleration and deceleration device 20 still function as described above. The same is true if the sliding door panel 2 is moved from the open position as shown in FIG. 6 only halfway to the closed position, see FIG. 7 and is then again opened. In each case, only one carrier element 111, 131 is in the end position 122, 142 remote from the park position. But it is also possible that both carrier elements 111, 131 are in their respective park positions 121, 141.

The acceleration and deceleration device 20 with park positions 121, 141 at the outer ends may also be so designed that in the cylinder only one piston is arranged which seals only in one stroke direction and which is connected to a carrier element. The second carrier element is then for example arranged at the bottom of a cylinder which is movable longitudinally relative to the guide components. With each deceleration then the piston and the cylinder move relative to each other. When moving into the cylinder, the piston seals. The park positions and the end positions at the carrier elements correspond to the positions as they are shown in FIGS. 1-8. In such an arrangement, the displacement chamber is always disposed—with the engagement of the left as well as the right operating element—between the piston and the cylinder bottom. The compensation chamber is disposed during opening as well as closing of the sliding door panel between the piston and the cylinder head through with the piston rod extends.

Figure 12:
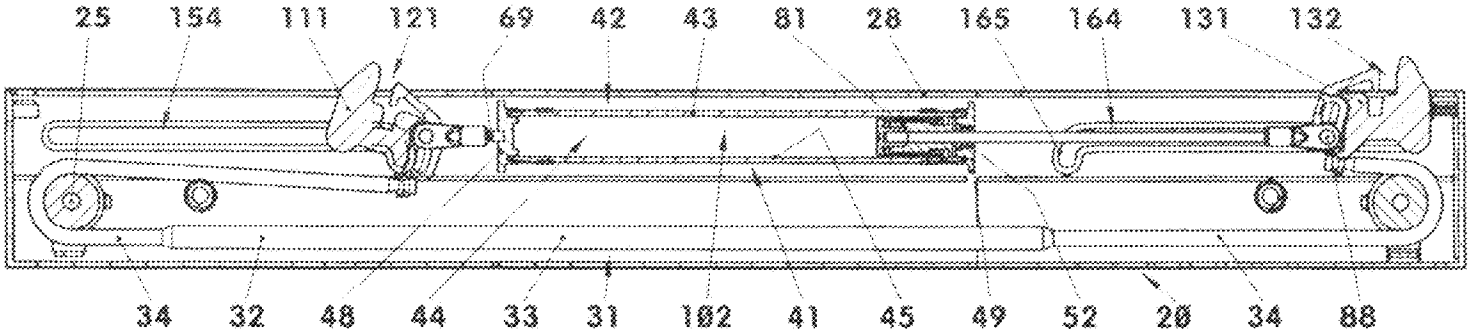
FIG. 12 shows an acceleration and deceleration device with internal park positions.

FIG. 12 is a longitudinal cross-sectional view of for example a pneumatic acceleration and deceleration device 20 with two carrier elements 111, 131 whose park positions 121, 141 are adjacent the cylinder. Also, with such an device 20, for example a guide system 10 for opening a sliding door panel 2 can be used as it is shown in FIGS. 1-3. The FIG. 13 is a perspective view of such a device 20.

Figure 14:
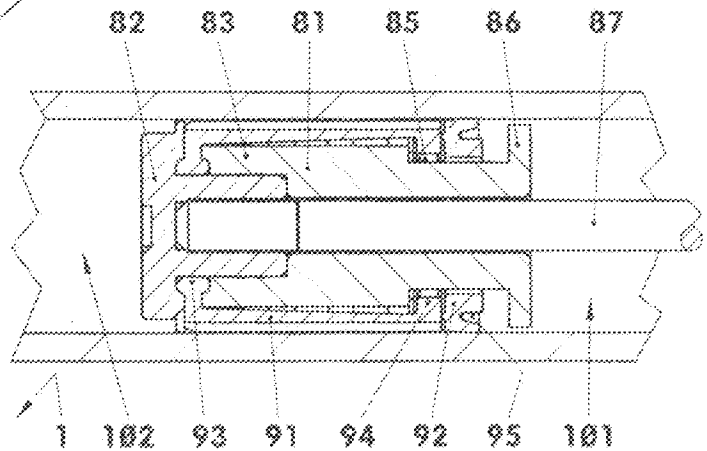
FIG. 14 shows a detail of FIG. 12.

In this exemplary embodiment, the acceleration and deceleration device 20 comprises only one piston 81, whose seal elements 91, 92 face in the direction of the piston rod seal 52, see FIGS. 12 and 14. This piston rod seal structure 52 seals the cylinder interior space 44 with respect to the ambient 1. The carrier element 131 which is shown in FIG. 12 at the right, is connected to the piston 81 via a piston rod 87. At the cylinder end wall 48, a rod 69 is arranged which connects the cylinder 43 to the carrier 111 arranged to the left. The cylinder 43 is supported in the housing 28 of the acceleration and deceleration device 20 so as to be longitudinally movable therein for example by means of the piston rod 87 and the piston 81 and/or by means of a bearing 26. The cylinder space 44 may be cylindrical, conical etc. In a conical embodiment, the cross-section 48 increases toward the cylinder head 49.

The two carrier elements 111, 131 are of a design similar to that described in connection with the first exemplary embodiment. They are interconnected by a tension spring 32. The tension spring 32 has a central section 33 of a relatively large diameter and two adjacent outer sections 34 which have for example half the cross-section of the central section 33. The narrower sections 34 extend each over a reversing roller 25.

Figure 13:
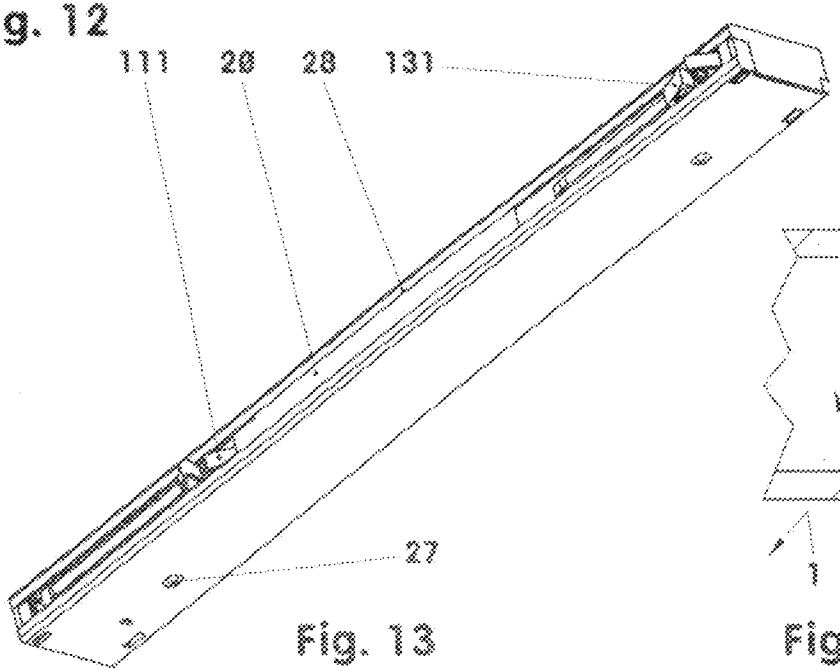
FIG. 13 is a perspective view of an arrangement according to the invention.

In the representation of FIGS. 12 and 13, the left carrier element 111 is shown in the park position 121 and the right carrier element 131 is shown in the end position 142 opposite the park position 141. Two through bores 27 facilitate the mounting of the acceleration and deceleration device 20 on the sliding door panel 2 or on an adapter component 15 attached to the sliding door panel 2.

FIG. 14 is a cross-sectional view of the area of the piston 81 of the acceleration and deceleration device 20. The piston 81 comprises for example a piston bottom part 82 consisting of a metallic material and a piston head part 83 which is arranged at the piston rod 87 and which is for example cemented to the piston bottom past 82. The piston rod 87 extends through the piston head part 83 and is for example threaded into the piston bottom part 82. A first piston seal element 91 is held in an engagement area 93 between the two piston parts 82, 83. This pot-shaped seal element 91 extends with an internal shoulder 94 into an accommodation area 85 without abutting the base thereof. In the accommodation area 85, another piston seal element 92 is loosely arranged, that is, for example a shaft seal ring 92 which includes an annular groove 95 facing toward the piston rod 87 and which is in contact with the cylinder wall 45. An abutment flange 86 retains the shaft seal in place.

The FIGS. 15-18 show the various positions of the acceleration and deceleration device 20 during closing of the sliding door. In this exemplary embodiment only one operating element 11 is arranged in the guide channel 9 which operating element 11 in FIGS. 15-18 is stationary while the acceleration and deceleration device 20 is movable for example from the left to the right. The sliding door panel travel distance 9 is in this case for example 400 mm. With a larger sliding door panel travel distance 9, it is also possible to use two operating elements 11, 12. The carrier elements 111, 131 and/or the operating elements 11, 12 are then displaced in a direction normal to the drawing plane of the FIGS. 15-18.

Figure 15:
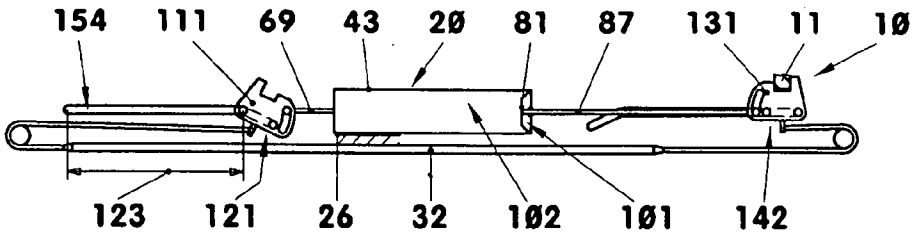
FIG. 15 shows an arrangement according to FIG. 12 with the sliding door open.
Figure 16:
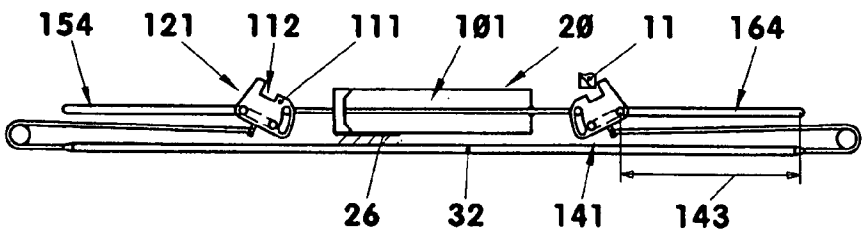
FIG. 16 shows an arrangement according to FIG. 12 upon release of the sliding door from the operating element.

In the start-out position shown in FIG. 15, which his for example with the sliding door panel 2 opened; the left carrier element 111 is in the park position 121. The right carrier element 131 is in engagement with the operating element 11. It is in the end position 142, which is opposite the park position, see also FIG. 12. The piston 81 is extended and is disposed in its right end position in the cylinder 43. The displacement chamber 101 is compressed and the compensation chamber 102 has its maximum volume. The energy storage device 32 is partially relaxed.

Figure 19:
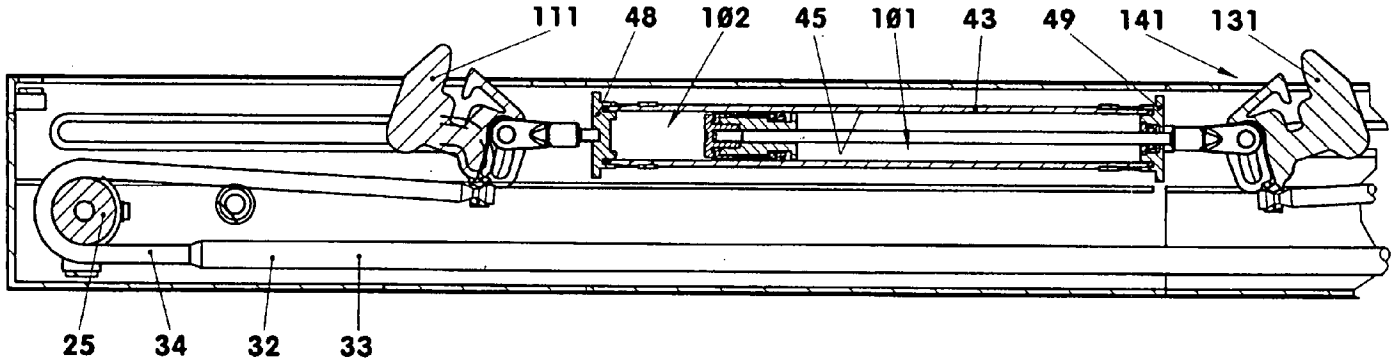
FIG. 19 shows a detail of the arrangement as shown in FIGS. 16 and 17.

During closing of the sliding door panel 2, the stationary operating element 11 moves the carrier element 131 to the park position 141. In the interior 44 of the cylinder air flows from the compensation chamber 102 to the displacement chamber 101 past the sealing elements 91, 92 and the piston 81 while deforming the sealing elements 91, 92. The piston 81 is moved into the cylinder 43, see FIG. 19. The tension spring 32 is being tensioned. As soon as the carrier element 131 has reached the parking position 141 the device 20 releases the operating element 11 (see FIG. 16).

Figure 17:
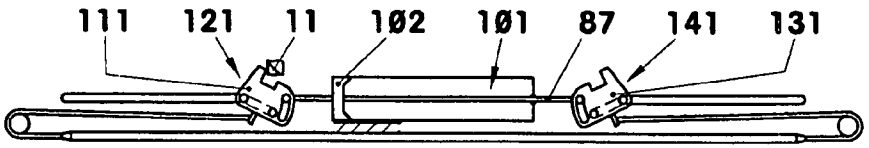
FIG. 17 shows an arrangement according to FIG. 12 before the sliding door comes in contact with the operating element.
Figure 18:
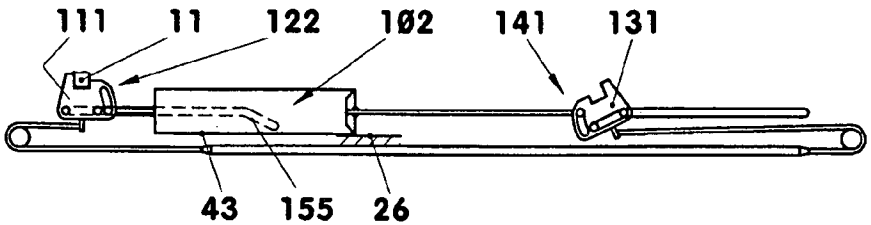
FIG. 18 shows the arrangement according to FIG. 12 with the sliding door closed.
Figure 20:
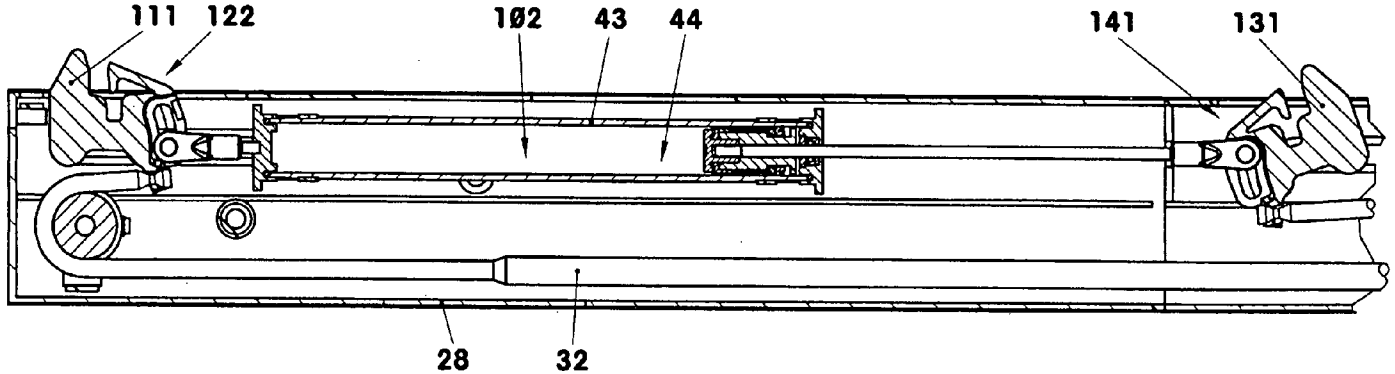
FIG. 20 shows a detail of the arrangement as shown in FIG. 18.

The sliding door panel 2 is now further closed until the left carrier element which is in the park position 121 comes into contact with the operating element 11, see FIG. 17. The carrier element 111 is then pulled out of the park position 121 in a direction toward the end position 122 which his opposite the park position. In the process, the carrier element 111 moves along the cylinder by means of the rod 69, see FIGS. 18-20. The cylinder 43 is moved to the left relative to the piston 81 which is locked by the right carrier element 131. Herein, the cylinder 43 is guided for example by a friction bearing structure 26. Within the cylinder space 44, the displacement chamber 101 is compressed. The seal elements 91, 92 of the piston 81 are pressed into engagement with the cylinder wall 45 and slow down—supported by the vacuum formed in the compensation chamber 10—the relative movement of the cylinder 43 relative to the piston 81. The sliding door panel 2 is slowed down. For example after passing a longitudinal groove formed in the cylinder wall 45 air flows out of the displacement chamber 101 into the compensation chamber 102. The pressure in the displacement chamber 101 collapses. The sliding door panel 2 now moves slowly, pulled by the relaxing tension spring 32, to its closed end position. There it stops without a jerk.

The opening of the sliding door panel 2 occurs in the reversed order. In FIGS. 15-18, the sliding door panel 2 is pulled by the acceleration and deceleration device 20 from the right to the left. Herein, first the left carrier element 111 is locked in the park position 121, see FIG. 17. It holds the cylinder 43 in its position. The tension spring 32 is tensioned. As soon as the right carrier element 131 reaches the operating element 11, see FIG. 16, it pulls the piston 81 to the right by means of the piston rod 87. The displacement chamber 101 is compressed. The seal elements 91, 92 abut the cylinder wall 45 and slow down the movement of the sliding door panel 2. At the same time, the tension spring 32 while relaxing, pulls the sliding door panel toward its open end position, see FIGS. 12 and 15.

Figure 21:
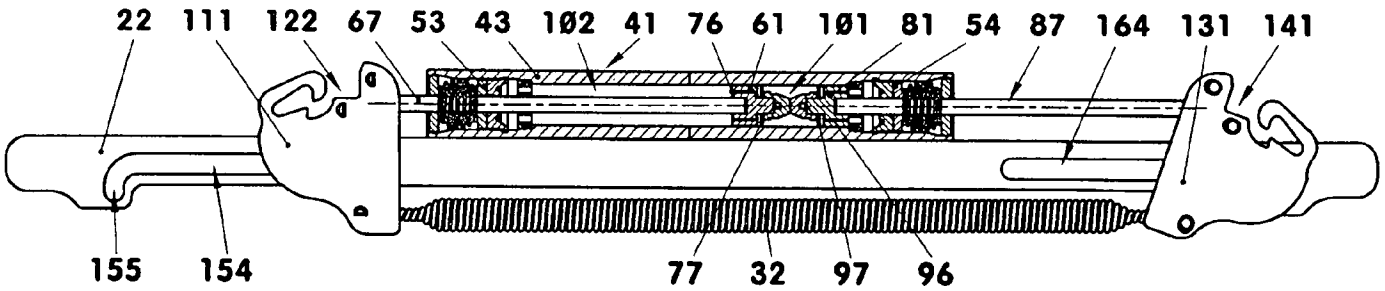
FIG. 21 shows an acceleration and deceleration device with a hydraulic deceleration structure.
Figure 22:
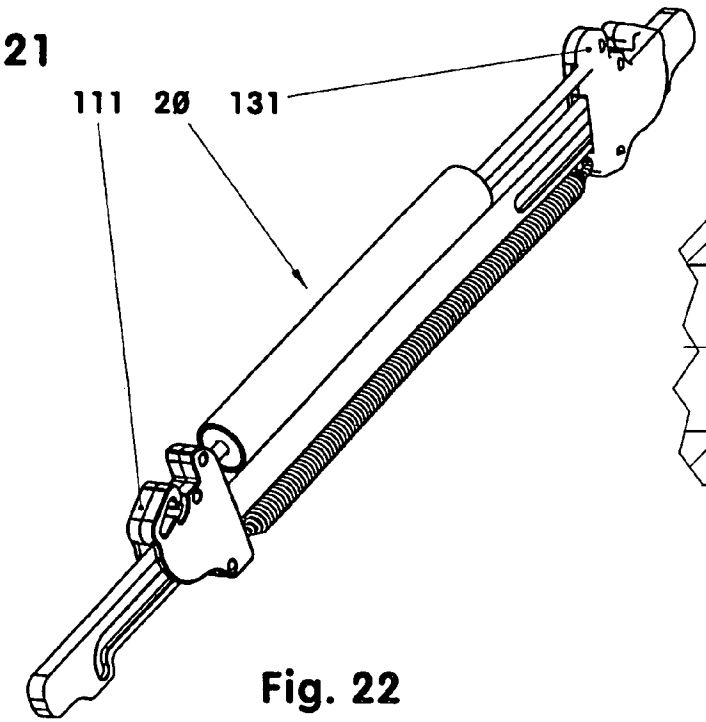
FIG. 22 is a perspective view of the arrangement according to FIG. 21.
Figure 23:
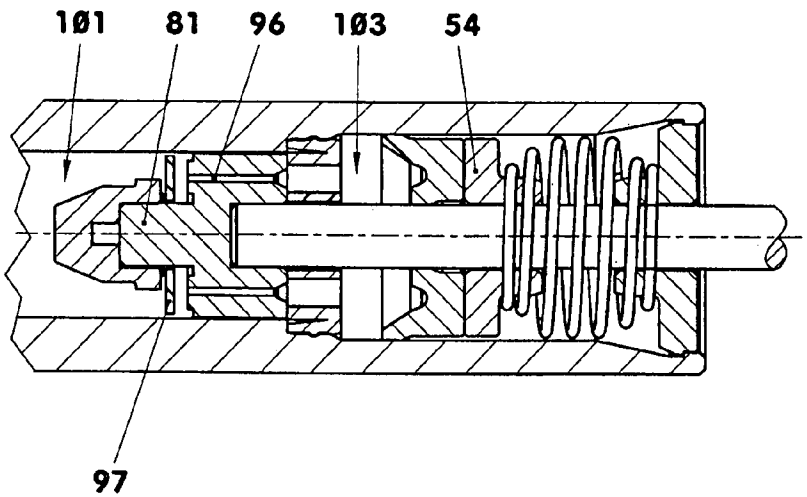
FIG. 23 shows a detail of FIG. 21.

FIGS. 21 and 22 show an acceleration and deceleration device 20 with a hydraulic deceleration structure 41 in a sectional and a perspective view. The device 20 shown includes a cylinder 43 with two pistons 61, 81 arranged therein which each are connected to a carrier element 111, 131 by means of a piston rod 67, 87. The displacement chamber 101 arranged between the pistons 61, 81 is in communication with the two compensation chambers 102, 103 via throttle bores 76, 96 formed in the pistons 61, 81. The latter ones are delimited each by a seal which is supported by a spring loaded plate 53, 54. The throttle channels 76, 96 are closed during insertion of a piston 61, 81 by valves 77, 97. During outward movement of the piston 61, 81 the valves 77, 97 are opened.

The acceleration and deceleration device 20 comprises a support structure 22 on which, in this exemplary embodiment, the cylinder 43 is mounted. The carrier elements 111, 131 are guided by the support structure 22 wherein the park position 121, 141 is the position of the respective carrier element 111, 131 which is farthest away from the cylinder 43. The two carrier elements 111, 131 extend around the support structure 22 and are interconnected by a tension spring 32. In this exemplary embodiment—with a sliding door panel length of 600 mm—the sum of the piston travel distances is 15% of the length of the sliding door panel length.

The operating sequence during opening and closing is analog to that described in connection with FIGS. 5-9 for a pneumatic device. In a hydraulic device 20 the deceleration is for example proportional to the speed. This means that, at a high speed of the sliding door panel 2 the deceleration is high. But if the sliding door panel 2 is opened or closed at a low speed the movement is only slightly slowed down.

The acceleration and deceleration devices 20 may be arranged at the stationary part of the door guide system 10. The operating element or elements 11, 12 are then mounted to the movable part.

Also combinations of the described exemplary embodiments are conceivable.

| Listing of Reference Numerals | |
|---|---|
| 1 | ambient |
| 2 | Sliding door panel |
| 3 | Door frames |
| 4 | Door opening |
| 5 | Vertical frame part |
| 6 | Door panel accommodating track |
| 8 | Guide channel |
| 9 | Door panel travel distance |
| 10 | Door guide system |
| 11 | Stationary guide part, left operating element |
| 12 | Stationary guide part, right operating element |
| 13 | Mounting element |
| 14 | Guide part, movable, second guide part |
| 15 | Adapter |
| 16 | Group of guide rollers |
| 17 | Guide roller |
| 20 | Acceleration and deceleration device |
| 21 | Cylinder tube |
| 22 | Support structure |
| 25 | reversing roller |
| 26 | Bearing structure |
| 27 | Throughbore |
| 28 | Housing |
| 31 | Acceleration device |
| 32 | Energy storage device, spring |
| 33 | Central section |
| 34 | Outer section |
| 41 | Deceleration device |
| 42 | Cylinder-piston unit |
| 43 | Cylinder |
| 44 | Cylinder interior |
| 45 | Internal cylinder wall |
| 46 | End wall |
| 47 | End side wall |
| 48 | Cylinder bottom end |
| 49 | Cylinder head end |
| 51 | Piston rod seal |
| 52 | Piston rod seal |
| 53 | Spring-load end plate |
| 54 | Spring-loaded plate |
| 61 | Piston |
| 62 | Piston bottom part |
| 63 | Piston head part |
| 64 | Free space |
| 65 | Accommodation area |
| 66 | Support flange |
| 67 | Piston rod |
| 68 | Piston head |
| 69 | Piston rod |
| 71 | Seal element |
| 72 | Seal element |
| 73 | Clamping area |
| 74 | Inner shoulder |
| 75 | Annular groove |
| 76 | Throttle bore |
| 77 | Valve |
| 81 | Piston |
| 82 | Piston bottom part |
| 83 | Piston head part |
| 84 | Free space |
| 85 | Accommodation area |
| 86 | Engagement flange |

-continued

| Listing of Reference Numerals | |
|---|---|
| 87 | Piston rod |
| 88 | Piston rod head |
| 91 | Seal element |
| 92 | Seal element |
| 93 | Clamping area |
| 94 | Inner shoulder |
| 95 | Annular groove |
| 96 | Throttle bore |
| 97 | Valve |
| 101 | Displacement chamber |
| 102 | Compensation chamber |
| 103 | Compensation chamber |
| 111 | Carrier element |
| 112 | Accommodation recess |
| 113 | Free carrier surface |
| 114 | Free carrier surface |
| 115 | Surface area |
| 121 | Park position |
| 122 | End position |
| 123 | Travel distance |
| 131 | Carrier element |
| 132 | Accommodation recess |
| 133 | Carrier surface |
| 134 | Carrier surface |
| 135 | Free surface area |
| 141 | Park position |
| 142 | End position |
| 143 | Travel distance |
| 151 | Frame structure |
| 152 | Guide structure |
| 153 | Guide structure |
| 154 | Elongated opening |
| 155 | Curved area |
| 156 | Inclination |
| 157 | Recess |
| 161 | Frame structure |
| 162 | Guide structure |
| 163 | Guide structure |
| 164 | Elongated opening |
| 165 | Curved area |
| 166 | Inclination |
| 167 | recess |

What is claimed is:

1. An acceleration and deceleration device (20) comprising an energy storage device (32), a cylinder (43) with first and second pistons (61, 81) disposed in the cylinder (43) and being movable therein by means of a first carrier element (111, 131), and a second carrier element (131, 111) guiding one of the first piston (61, 81) and the second piston (81, 61) for movement in the cylinder (43) relative to the second and, respectively, the first piston (61, 81), the carrier elements (111, 131) being connected to the pistons (61, 81) so as to be movable therewith over predetermined stroke lengths, the sum of the stroke lengths of the carrier elements (111, 131) being greater than the length of the cylinder interior.

2. An acceleration and deceleration device according to claim 1, wherein each piston (61, 81) separates in the cylinder (43), a displacement chamber (101) from a compensation chamber (102, 103).

3. An acceleration and deceleration device according to claim 1, wherein between the two pistons (61, 81) a displacement chamber (101) is formed in the cylinder (43).

4. An acceleration and deceleration device according to claim 1, wherein the energy storage device (32) is connected to both carrier elements (111, 131).

5. An acceleration and deceleration device according to claim 1, wherein the acceleration and deceleration device comprises a hydraulic deceleration structure.

6. A sliding door including a sliding door panel (2) and an acceleration and deceleration device (20) comprising an energy storage device (32), a cylinder (43) with first and second pistons (61, 81) disposed in the cylinder (43) and being movable therein by means of a first carrier element (111, 131) and a second carrier element (131, 111) each being connected to a respective one of the first piston (61, 81) and the second piston (81, 61) for movement with the respective piston in the cylinder (43) relative to the other piston (61, 81) over predetermined stroke lengths, the sum of the stroke lengths of the carrier elements (111, 131) being greater than the length of the cylinder interior.

7. A sliding door according to claim 6, wherein the sliding door panel (2) has in the direction of its movability a length which is not greater than 600 mm.

* * * * *